United States Patent [19]

Battersby et al.

[11] 4,055,402

[45] Oct. 25, 1977

[54] GASOLINE COMPOSITION

[75] Inventors: John Battersby, Frimley; Eric Simon Forbes, Lightwater; Angus Joseph Dickson Reid, Old Windsor, all of England

[73] Assignee: The British Petroleum Company Limited, London, England

[21] Appl. No.: 489,893

[22] Filed: July 19, 1974

Related U.S. Application Data

[62] Division of Ser. No. 416,962, Nov. 19, 1973, abandoned.

[30] Foreign Application Priority Data

Nov. 29, 1972 United Kingdom ..... 55087/72

[51] Int. Cl.[2] ..... C10L 1/22

[52] U.S. Cl. ..... 44/58; 44/72

[58] Field of Search ..... 44/58, 72; 260/584 R

[56] References Cited

U.S. PATENT DOCUMENTS

| | | | |
|---|---|---|---|
| 2,695,222 | 11/1954 | Chenicek et al. | 44/72 |
| 3,018,173 | 1/1962 | Cyba | 44/72 |
| 3,197,510 | 7/1965 | Cyba | 260/584 R |
| 3,755,433 | 8/1973 | Miller et al. | 252/51.5 R |

*Primary Examiner*—Allen B. Curtis
*Assistant Examiner*—Mrs. Y. Harris-Smith
*Attorney, Agent, or Firm*—Morgan, Finnegan, Pine, Foley & Lee

[57] ABSTRACT

Polybutene polyamine alcohols are prepared by reacting a halogenated polybutene with a polyamino alcohol. They have good properties as carburetor detergents.

5 Claims, No Drawings

GASOLINE COMPOSITION

This is a division of application Ser. No. 416,962, filed Nov. 19, 1973, now abandoned.

This invention relates to hydroxy-substituted polyamino compounds which are suitable for use as gasoline additives.

In internal combustion engines using gasoline as a fuel and having a carburettor there is a possibility, with some gasolines, of deposits of a gummy or sticky nature being deposited on the carburettor. In order to reduce the formation of these deposits and/or remove them when they are formed, additives are incorporated into the gasoline. These additives are known as carburettor detergents.

According to the present invention there is provided a compound of formula:

(I)

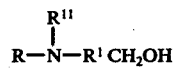

where R is a hydrocarbyl group containing at least 20 carbon atoms, $R^1$ is an amino substituted hydrocarbyl group, and $R^{11}$ is a hydrogen atom or an alkyl group containing 1 to 4 carbon atoms.

The group R preferably contains from 20 to 500 carbon atoms, most preferably from 30 to 150 carbon atoms.

R is preferably a hydrocarbyl group derived from the polymerization of an olefin. Suitable olefins include ethylene, propylene, butylenes, and 4-methylpentene-1. The preferred olefin is isobutylene.

$R^1$ is preferably a polymethylene group containing 2 to 5 carbon atoms which is associated with an amino group, e.g, of formulae:

$-CH_2CH_2NHCH_2-$, or $-CH_2CH_2CH_2NHCH_2CH_2-$ $R^{11}$ is preferably hydrogen.

According to another aspect of the invention there is provided a method of preparing a compound of formula:

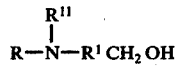

which comprises reacting an alkanolamine of formula:

(II)

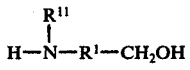

with a hydrocarbyl halide of formula:

$R-X$ where R, $R^1$ and $R^{11}$ are as hereinbefore defined and X is chloride or bromide.

Preferably the hydrocarbyl halide contains on average between 1.4 to 2.0 halogen atoms per molecule of hydrocarbyl halide.

Preferably the molar ratio of alkanolamine to hydrocarbyl halide is in the ratio 2:1 to 5:1.

In the reaction of the alkanolamine with the hydrocarbyl halide, hydrogen halide is formed, which can be conveniently removed by carrying out the reaction in the presence of an acid acceptor, e.g. sodium carbonate.

The reaction is preferably carried out in the presence of an inert solvent, e.g., xylene. The reaction takes place at elevated temperature, suitably in the range 100° to 190° C, preferably in the range of 140° to 160° C.

The preferred alkanolamine of Formula II is N-(2-aminoethyl) ethanolamine.

According to a further feature of the invention there is provided a gasoline composition comprising gasoline and up to 1000 parts per million, preferably 50–200 parts per million, of a compound of Formula (I) above.

The composition may also contain a lubricating oil in small amount, e.g., 500 ppm.

The invention will now be described with reference to the following Examples.

EXAMPLE 1

A flask fitted with a reflux condenser was flushed with nitrogen and charged with N-(2-aminoethyl) ethanolamine (260g,) sodium carbonate (40g, ) and xylene (300 mls). The mixture was stirred vigorously and heated to boiling point. Chlorinated polyisobutene (650g, ~95C atoms, 1.8 Cl/mol) was added slowly to the refluxing mixture and after the addition was complete (c.a. 1 hour) the mixture was refluxed for a further 4 hours. The product was cooled, filtered and the excess solvent and aminoalcohol removed by distillation under reduced pressure. The product, 640 g of a brown oil, contained 1.44%N.

EXAMPLE 2

A flask fitted with a reflux condenser was flushed with nitrogen and charged with chlorinated polyisobutene (500 g. ~95 C atoms, 1.8 Cl/mol.), N-2-(aminoethyl) ethanolamine (160g.), xylene (150 ml) and sodium carbonate (50g.). The mixture was stirred and refluxed under nitrogen for 6 hours. The product was then cooled, the lower layer of excess aminoalcohol removed and the upper layer washed twice with 100 ml water and dried over magnesium sulphate. The solvent was then removed by distillation under reduced pressure to give 515 g. of a brown oil containing 1.2% nitrogen.

The products formed were tested for carburettor detergency properties in a carburettor detergency test using a Ford 105E (997cc) bench engine which is run for 4 hours with a brake loading sufficient to produce an inlet manifold depression of 6.5 inches Hg at 1600 rpm. (test speed). All crankcase gases are recycled into the air cleaner together with a proportion of exhaust gas. At the end of the test the carburettor is rated visually for deposits and rated on an arbitary 0–10 scale, 10 indicating a perfectly clean carburettor.

The following results were obtained.

| Additive | Concentration ppm | % N | Rating |
|---|---|---|---|
| None (i.e., fuel alone) | — | — | 2.5–3 |
| Product of Example 1 | 100 | 1.44 | 8.0 |
| Product of Example 2 | 100 | 1.2 | 8.0 |

We claim:

1. A fuel composition comprising a gasoline and from 50 to 200 parts per million of a carburetor detergent compound of the formula:

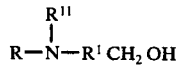

wherein R is a hydrocarbyl group containing from 20 to 500 carbon atoms and derived from the polymerization of isobutene, $R^1$ is a polymethylene group containing 2 to 6 carbon atoms and an amino group and $R^{11}$ is a hydrogen or an alkyl group containing 1 to 4 carbon atoms.

2. A composition according to claim 1 wherein R is a hydrocarbyl group containing 30 to 150 carbon atoms.

3. A composition according to claim 1 wherein R is derived from the polymerization of an olefin.

4. A composition according to claim 1 wherein $R^1$ is of formula $—CH_2CH_2NHCH_2—$, or $—CH_2CH_2CH_2NHCH_2CH_2—$.

5. A composition according to claim 1 containing up to 500 ppm of a lubricating oil.

* * * * *